US005235397A

United States Patent [19]

Van Der Sterren

[11] Patent Number: 5,235,397

[45] Date of Patent: Aug. 10, 1993

[54] DEVICE FOR GUIDING A SHEET EXITING A TRANSPORT NIP

[75] Inventor: Martin L. Van Der Sterren, Roermond, Netherlands

[73] Assignee: Oce-Nederland B.V., Venlo, Netherlands

[21] Appl. No.: 520,677

[22] Filed: May 8, 1990

[30] Foreign Application Priority Data

May 19, 1989 [NL] Netherlands ..... 8901254

[51] Int. Cl.[5] ..... G03G 21/00

[52] U.S. Cl. ..... 355/315; 355/308

[58] Field of Search ..... 271/272, 273, 274, 307, 271/311, 193, 18.1, 308, 313, 900; 355/315, 308, 271, 277

[56] References Cited

U.S. PATENT DOCUMENTS

| | | | |
|---|---|---|---|
| 3,820,776 | 6/1974 | Fujimoto et al. | 271/308 |
| 3,926,429 | 12/1975 | Satomi et al. | 271/900 X |
| 4,417,800 | 11/1983 | Hirose et al. | 271/313 X |
| 4,474,368 | 10/1984 | Petter, III et al. | 271/308 |

*Primary Examiner*—A. T. Grimley
*Assistant Examiner*—Sandra L. Brasé
*Attorney, Agent, or Firm*—Reed Smith Shaw & McClay

[57] ABSTRACT

A device for guiding a sheet at the exit side of a transport nip formed by a pair of rollers is provided with a movable guide member having a thin end. When the device is in a position of rest, the guide member occupies a position such that the thin end is situated close to but not touching the transport nip. The leading edge of a sheet fed through the transport nip is intercepted by the thin end of the guide member, by means of an operative electrostatic force, whereafter the sheet pushes the guide member ahead of itself and is thereby separated from the nip-forming surfaces of the pair of rollers.

9 Claims, 1 Drawing Sheet

DEVICE FOR GUIDING A SHEET EXITING A TRANSPORT NIP

FIELD OF THE INVENTION

The present invention relates to a device for guiding a sheet, after passing through a transport nip formed by nip-forming surfaces, in a direction away from the nip-forming surfaces.

BACKGROUND OF THE INVENTION

When a sheet is transported between a nip formed by nip-forming surfaces it is desirable that after passing through the nip the sheet should not remain in contact with one of the nip-forming surfaces but should be and remain separated therefrom. Two different phases can be described in such separation: a first phase in which the leading part of the sheet comes out of the nip, and a second phase in which the remainder of the sheet comes out of the nip. The sheet separation during the first phase, i.e. disengagement of the sheet from the nip-forming surfaces at the exit side of the nip, is governed by a number of factors, such as the nip geometry, the bending strength of the sheet and the forces operative on the sheet at the nip. The leading edge of a sheet will readily disengage from a nip-forming surface if it has a small radius of curvature at the exit side, but will disengage with greater difficulty from a nip-forming surface if it has a large radius of curvature at the exit side. Adhesion forces and electrostatic forces operative in the nip will also render separation difficult. With conventionally formed nips, sheet separation is readily achieved during the first phase for many types of sheets. When however a large portion of the sheet has passed through the nip, that portion, since it is limper, may be pulled back to one of the nip-forming surfaces by a small force, so that the separation achieved in the first phase is destroyed in the subsequent second phase. This may readily occur particularly as a result of electrostatic attraction forces continuing to be operative between the sheet and the nip-forming surface and particularly when a nip-forming surface has a large radius of curvature at the nip exit side.

In the sheet handling device described in U.S. Pat. No. 4,062,631, the nip-forming surfaces are formed by a first roller and by a belt which is pressed against the first roller by a second roller, the belt having a larger radius of curvature at the nip discharge side than the first roller. The guide member consists of a guide roller disposed at the exit side of the nip at a fixed location and rotating in one direction. The guide roller exerts an electrostatic attraction force on a charged sheet coming from the nip which tends to keep the sheet separated from the belt in opposition to the electrostatic attraction which exists between the charged sheet and the belt. Since the guide roller cannot be disposed close to the nip, because of its roller shape, the separation force exerted by the guide roller cannot become operative until a relatively large portion of the sheet has left the nip. In addition, the separation force must overcome the force of attraction between the sheet and the belt. The separation force must be generated by the charge present on the sheet, so that the sheet must be capable of receiving a considerable charge for the purposes of separation. This restricts this device to processing specific types of sheets.

The devices shown in U.S. Pat. Nos. 4,004,802 and 4,370,048 as well as German Patent No. 475,563 all disclose a guide member for guiding a sheet at the exit side of a transport nip away from the nip-forming surfaces wherein an end of the guide member contacts one of the nip-forming surfaces, preferably the surface having the greater radius of curvature. Damage to the nip-forming surface can result from repeated contact by the guide member.

The devices shown in U.S. Pat. Nos. 3,820,776 and 3,506,259 as well as those shown in the IBM Technical Disclosure Bulletins entitled "Mechanical Stripper", Vol. 16, No. 9, February 1974 and "Mechanical Stripper with Drum Stop", Vol. 19, No. 5, October 1976, are for separating the leading edge of a sheet firmly attached to one moving surface such as a photo-conductive drum. These devices do not show a guide device used at the exit end of a nip for guiding a sheet away from the nip-forming surfaces.

It would be desirable therefore, to have a sheet guiding device for use at the exit end of a nip which did not have these disadvantages and which was suitable for 1 processing many different kinds of sheets.

SUMMARY OF THE INVENTION

Generally, the present invention provides a device for guiding a sheet comprising a movable guide member disposed near an exit side of a transport nip such that the guide member can intercept a leading part of a sheet exiting from between two nip-forming surfaces of the transport nip and guide the sheet away from the nip-forming surfaces, wherein the movable guide member is movable to and fro between a first position and a second position and is provided with a thin end which in the first position, without touching the nip-forming surfaces, extends to a distance from the transport nip short enough to intercept the leading edge of the sheet exiting the transport nip and in the second position is situated at a greater distance from the transport nip and the nip-forming surfaces but still in contact with the sheet. Thus, a sheet exiting the transport nip is caught and is reliably separated from the nip-forming surfaces.

Preferably, the guide member is so constructed as to be easily displaceable from the first position to the second position by the intercepted and advancing sheet. Consequently, no drive means, other than the sheet itself, is required to move the guide member from the first position to the second position.

In one embodiment of the present invention, in which the nip-forming surfaces have different radii of curvature at the exit side of the transport nip, the distance between the thin end of the guide member and the nip-forming surface having the larger radius of curvature is smaller than the distance between the thin end and the nip-forming surface having the smaller radius of curvature when the guide member is in the first position. As a result of this construction, in the first phase of the sheet separation process, the leading part of the sheet can readily be guided between the guide member and the nip-forming surface having the smallest radius of curvature, whereafter in the second phase of the sheet separation process the leading part of the sheet is pulled in the direction of the thin end of the guide member partly by the electrostatic attraction force exerted by the nip-forming surface having the largest radius of curvature, and is held fast thereon. As a result, even sheets which can only receive a small electrostatic charge can be separated reliably from nip-forming surfaces by the guide member of the present invention.

Other details, objects and advantages of the present invention will become apparent as the following description of a presently preferred embodiment of practicing the invention proceeds.

BRIEF DESCRIPTION OF THE DRAWINGS

In the accompanying drawings, a preferred embodiment of the present invention is illustrated wherein.

DETAILED DESCRIPTION OF THE INVENTION

Figure 1:
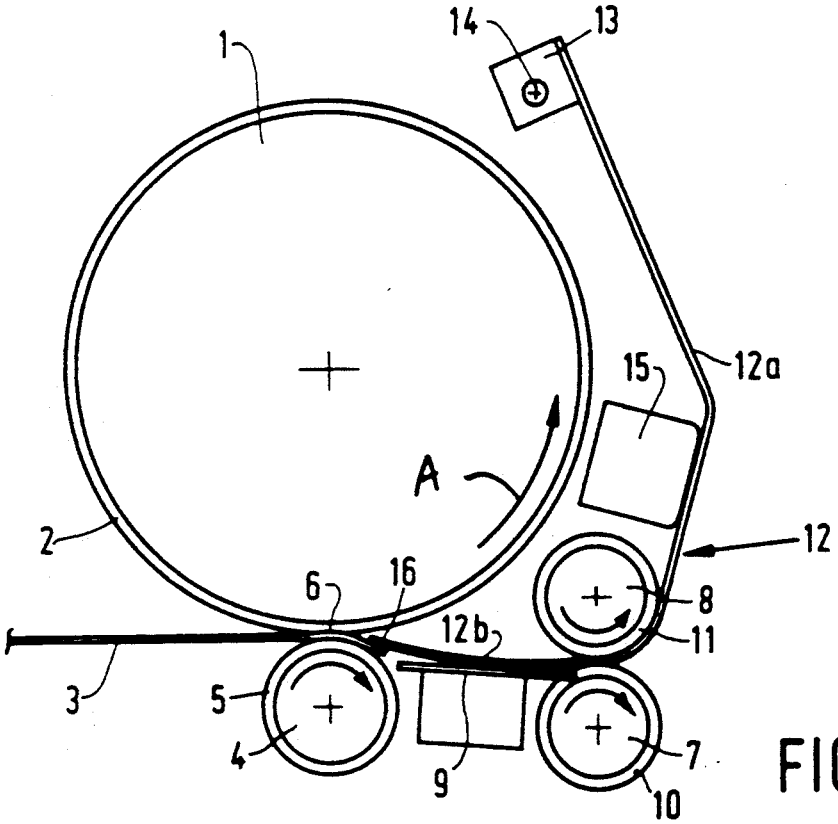
FIG. 1 is diagrammatic cross-section of the present sheet guiding device in a position of rest.

The device shown in the drawings comprises a horizontally extending roller 1 preferably having a diameter of 100 mm, which is covered with a layer of silicone rubber 2. Roller 1 can be driven in a direction indicated by arrow A by a drive means (not shown). Roller 1 preferably acts as an image transfer roller which can receive on its silicone rubber layer 2 a powder image from a photoconductive drum (not shown). The powder image is then transferred from the image transfer roller 1 to a receiving sheet 3. To this end, receiving sheet 3 is pressed by a pressure roller 4 against the underside of the image transfer roller 1 in a manner such as is described in allowed U.S. patent application Ser. No. 07/427,827 filed Oct. 26, 1989, which disclosure is incorporated herein by reference.

Pressure roller 4 preferably has a diameter of 25 mm and is covered with a layer 5 of material which is adhesive to powder, such as silicone rubber or fluoroethylenepropylene. Layer 5 has a hardness such that when the image transfer roller 1 and pressure roller 4 are pressed against one another, the layer of silicone rubber 2 on the image transfer roller 1 is pressed in more than the layer 5 on the pressure roller 4. Consequently, a receiving sheet 3 fed through the transport nip 6 formed between the image transfer roller 1 and the pressure roller 4 is compelled to deflect its leading portion from the image transfer roller 1 without such leading portion of the receiving sheet being able to follow the surface of the more considerably curved pressure roller 4.

A pair of cooperating transport rollers 7 and 8 is disposed at some distance from the transport nip 6. This pair of transport rollers 7 and 8 is used to discharge the receiving sheet 3 fed through the transport nip 6. A guide plate 9 is disposed in the zone between the transport nip 6 and the pair of transport rollers 7, 8 and is used to guide that side of the receiving sheet 3 which is remote from the image transfer roller 1. Preferably, guide plate 9 extends from near the surface of the pressure roller 4 as far as the bottom transport roller 7 of the pair 7 and 8. At roller 7, guide plate 9 is provided with projections which fit into continuous grooves 10 formed in the transport roller 7.

A guide member 12, preferably formed by a plurality of bent strips situated in one plane, is secured at one end to a block 13 freely rotatable about a shaft 14 which extends in a direction parallel to the axes of 1 rotation of the rollers 1, 4, 7 and 8, and which is preferably situated approximately 100 mm above the transport rollers 7 and 8. The plurality of bent strips extend from block 13 about the transport roller 8 to near the nip 6, each strip being freely movable within continuous grooves 10 and 11 formed respectively in the rollers 7 and 8. The center of gravity of guide member 12 is so located that the guide member when in the position shown in FIG. 1 rests against an abutment 15 disposed on that side of guide member 12 which faces the image transfer roller 1. The free ends of the plurality of strips form a thin end 16 of the guide member, which thin end 16 in the first position or rest position of the device is preferably situated at a distance of about 1 mm from the surface of the image transfer roller 1 and at a distance of about 3 mm from the surface of the pressure roller 4. The thin end 16 extends substantially parallel to the surface of the pressure roller 4. The guide member 12 preferably consists of an electrically conductive material and is grounded. Good separation results are obtained with a guide member whose thin end is situated at a distance of 3 to 12 mm from the transport nip when the device is in the rest position.

The operation of the above-described device will now be explained. After passing the transport nip 6, the leading part of a receiving sheet 3 fed through the transport nip 6 is automatically separated from the surfaces of the image transfer roller 1 and pressure roller 4 as a result of the shape of the transport nip. The leading part of receiving sheet 3 is fed to the discharge side of the transport nip 6 in the space bordered, on the one hand, by the surface of the pressure roller 4 and, on the other hand, by the underside of the thin end 16 of guide member 12. As a result of the electrostatic charge present on the receiving sheet 3, which charge is be generated by tribo-electric forces operative in the nip, mirror charges are generated in the adjacent thin end 16 of the grounded guide member 12 which tends to pull the leading part of the receiving sheet 3 against the underside of the thin end 16 and hold it thereon. The charge present on the image transfer roller 1 may intensify this attracting action.

Figure 2:
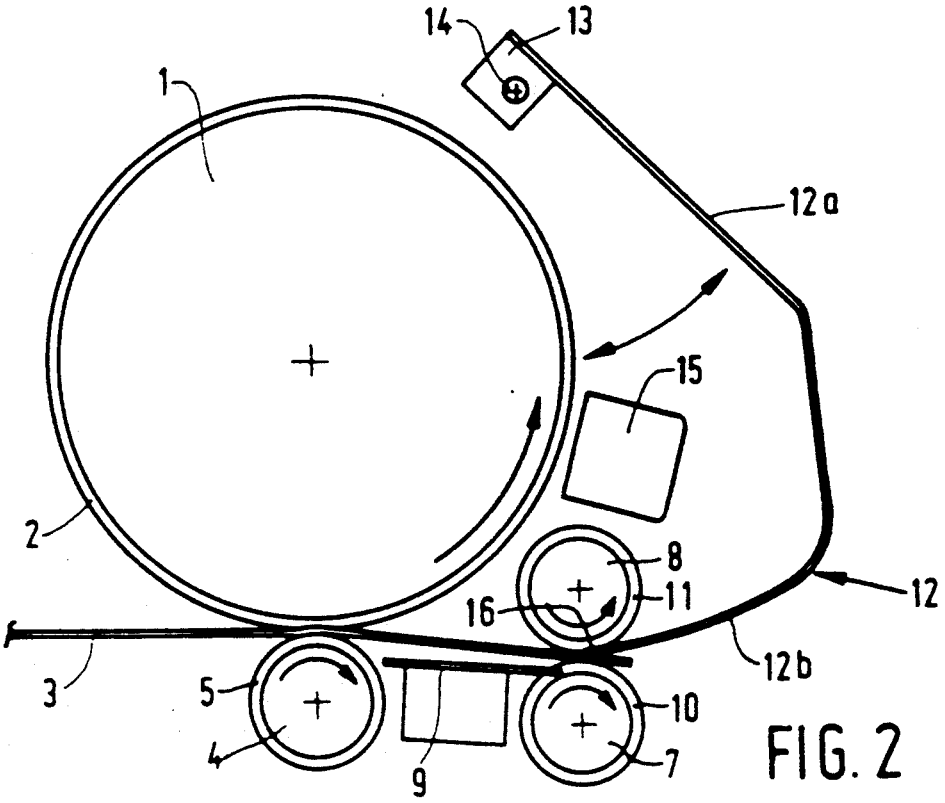
FIG. 2 shows the device of FIG. 1 in a different position.

The receiving sheet 3 as it moves through the transport nip 6 then pushes the guide member 12 ahead of itself, the guide member 12 rotating about shaft 14, such that both are transported in the direction of the transport rollers 7 and 8. When the leading part of the receiving sheet 3 has been fed into the nip between the transport rollers 7 and 8, which situation is shown in FIG. 2, these transport rollers 7 and 8 pull the receiving sheet 3 away from the guide member 12 and the latter falls by its own weight back into the starting position shown in FIG. 1, awaiting a subsequent receiving sheet 3 transported through the transport nip 6.

The receiving sheet 3 may also be held on the movable guide member 12 by mechanical forces instead of electrostatic forces. In that case, the thin end of the guide member 12 is provided with a notch, into which, in the first position of guide member 12, the leading edge of the receiving sheet runs and is retained therein during the pushing ahead of the guide member 12 into the second position. In this embodiment the guide member 12 need not be electrically conductive and earthed.

While a presently preferred embodiment of practicing the invention has been shown and described with particularity in connection with the accompanying drawings, the invention may be otherwise embodied within the scope of the following claims.

What is claimed is:

1. A device for guiding a sheet, after passing a transport nip formed by nip-forming surfaces, in a direction away from the nip-forming surfaces, the device comprising a movable guide member disposed near an exit side of the transport nip, which guide member can intercept a leading part of the sheet and can guide the sheet away from the nip-forming surfaces, wherein the guide member is movable to and fro between a first position and second position and is provided with a thin end which in the first position, without touching the nip-forming surfaces, extends to a distance from the transport nip short enough to intercept the leading edge of the sheet advanced through the transport nip, and in the second position is situated at a greater distance from the transport nip and the nip-forming surfaces.

2. A device as described in claim 1 wherein the movable guide member can be displaced from the first position to the second position by the motion of the sheet.

3. A device as described in claim 1 wherein the moveable guide member comprises a plurality of bent strips.

4. A device as described in claim 3 wherein the guide member is comprised of an electrically conductive material which is grounded.

5. A device as described in claim 1 wherein a cooperating pair of rollers is disposed near the position where the thin end is located when the guide member is in the second position, at least one roller of the pair having a continuous recess through which the guide member can move freely when it moves between the first position and the second position.

6. A device as described in claim 5 wherein the guide member is rotatable about a shaft extending parallel to the transport nip, the shaft located at the end of the guide member opposite the thin end, and wherein an abutment is provided which holds the guide member in the first position when it is not engaging the sheet.

7. A device as described in claim 1 wherein the nip-forming surfaces have curvatures with different radii of curvature at the exit side of the transport nip and wherein when the guide member is in the first position, the distance between the thin end of the guide member and the nip-forming surface having the larger radius of curvature is smaller than the distance between the thin end of the guide member and the nip-forming surface having the smaller radius of curvature.

8. A device as described in claim 1 wherein the guide member is comprised of an electrically conductive material which is grounded.

9. A device as described in claim 2 wherein the guide member is comprised of an electrically conductive material which is grounded.

* * * * *